US009546503B2

(12) United States Patent
Krueger

(10) Patent No.: US 9,546,503 B2
(45) Date of Patent: Jan. 17, 2017

(54) ELECTROMECHANICAL ROTARY LATCH

(71) Applicant: Dale R. Krueger, Woodstock, IL (US)

(72) Inventor: Dale R. Krueger, Woodstock, IL (US)

(73) Assignee: Questek Manufacturing Corporation, Elgin, IL (US)

( * ) Notice: Subject to any disclaimer, the term of this patent is extended or adjusted under 35 U.S.C. 154(b) by 0 days.

(21) Appl. No.: 14/199,315

(22) Filed: Mar. 6, 2014

(65) Prior Publication Data

US 2014/0252784 A1 Sep. 11, 2014

Related U.S. Application Data

(60) Provisional application No. 61/773,474, filed on Mar. 6, 2013.

(51) Int. Cl.

| | |
|---|---|
| ***E05C 3/00*** | (2006.01) |
| ***E05B 47/00*** | (2006.01) |
| ***E05B 47/06*** | (2006.01) |
| ***E05C 3/24*** | (2006.01) |
| *E05C 3/16* | (2006.01) |
| *E05C 3/14* | (2006.01) |
| *E05C 3/12* | (2006.01) |
| *E05C 3/22* | (2006.01) |

(52) U.S. Cl.

CPC ..... *E05B 47/0012* (2013.01); *E05B 47/06* (2013.01); *E05C 3/24* (2013.01); *E05B 2047/002* (2013.01); *E05C 3/00* (2013.01); *E05C 3/12* (2013.01); *E05C 3/14* (2013.01); *E05C 3/16* (2013.01); *E05C 3/22* (2013.01); *Y10T 292/1051* (2015.04); *Y10T 292/1062* (2015.04); *Y10T 292/1079* (2015.04)

(58) Field of Classification Search

CPC ..... E05C 3/00; E05C 3/12; E05C 3/14; E05C 3/16; E05C 3/22

USPC ..... 292/201, 216

See application file for complete search history.

(56) References Cited

U.S. PATENT DOCUMENTS

| | | | | |
|---|---|---|---|---|
| 3,566,703 | A * | 3/1971 | Van Noord | 74/50 |
| 5,439,260 | A * | 8/1995 | Weinerman et al. | 292/48 |
| 5,611,224 | A * | 3/1997 | Weinerman et al. | 70/208 |
| 5,639,130 | A * | 6/1997 | Rogers et al. | 292/216 |
| 5,884,948 | A * | 3/1999 | Weinerman et al. | 292/216 |
| 5,909,918 | A * | 6/1999 | Kowalewski et al. | 292/199 |
| 5,992,194 | A * | 11/1999 | Baukholt et al. | 70/279.1 |

(Continued)

FOREIGN PATENT DOCUMENTS

| | | |
|---|---|---|
| EP | 812972 | * 12/1997 |

*Primary Examiner* — Carlos Lugo

(74) *Attorney, Agent, or Firm* — Cook Alex Ltd.

(57) ABSTRACT

A rotary latch has a housing having first and second posts therein. A catch is mounted for rotation about the first post between latched and unlatched positions. A pawl is mounted for rotation about the second post between a catch-retaining position and a catch-releasing position. When the catch is in the latched position and the pawl is in the catch-retaining position, the pawl engages the catch and prevents it from rotating out of the latched position. When the pawl is in the catch-releasing position the catch is movable to its unlatched position. A motor and gear train mounted in the housing includes an output gear mounted for rotation about the second post. The output gear is in engagement with the pawl such that activation of the motor causes the output gear to rotate the pawl to the catch-releasing position.

4 Claims, 22 Drawing Sheets

(56) References Cited

U.S. PATENT DOCUMENTS

| | | | | |
|---|---|---|---|---|
| 6,056,334 | A * | 5/2000 | Petzold et al. | 292/216 |
| 6,279,361 | B1 * | 8/2001 | Baukholt et al. | 70/279.1 |
| 6,308,587 | B1 * | 10/2001 | Shinkawa et al. | 74/89.25 |
| 6,371,537 | B1 * | 4/2002 | Vige et al. | 292/201 |
| 6,386,599 | B1 * | 5/2002 | Chevalier | 292/201 |
| 6,390,517 | B1 * | 5/2002 | Ehret | 292/201 |
| 6,471,260 | B1 * | 10/2002 | Weinerman et al. | 292/216 |
| 6,474,704 | B1 * | 11/2002 | Rathmann et al. | 292/201 |
| 6,523,376 | B2 * | 2/2003 | Baukholt et al. | 70/256 |
| 6,598,911 | B2 * | 7/2003 | Mejean et al. | 292/201 |
| 6,695,361 | B1 * | 2/2004 | Gleason et al. | 292/216 |
| 6,973,810 | B2 * | 12/2005 | Chen | 70/208 |
| 7,163,239 | B2 * | 1/2007 | Fisher | 292/216 |
| 7,192,066 | B2 * | 3/2007 | Ilea et al. | 292/201 |
| 7,267,380 | B2 * | 9/2007 | Bullock et al. | 292/337 |
| 7,497,488 | B2 * | 3/2009 | Chen | 292/216 |
| 7,500,700 | B2 * | 3/2009 | Kunst | 292/201 |
| 8,672,368 | B2 * | 3/2014 | Grosdemouge | 292/201 |
| 8,757,679 | B2 * | 6/2014 | Torkowski et al. | 292/201 |
| 2004/0123636 | A1 * | 7/2004 | Linares | 70/159 |
| 2004/0178643 | A1 * | 9/2004 | Marzolf et al. | 292/201 |
| 2005/0206172 | A1 * | 9/2005 | Bacon | E05B 17/0004 292/216 |
| 2006/0006668 | A1 * | 1/2006 | Hidding et al. | 292/216 |
| 2006/0267349 | A1 * | 11/2006 | Garneau et al. | 292/144 |
| 2011/0089705 | A1 * | 4/2011 | Barth et al. | 292/226 |
| 2015/0145265 | A1 * | 5/2015 | Weinerman et al. | 292/201 |

* cited by examiner

ELECTROMECHANICAL ROTARY LATCH

CROSS-REFERENCE TO RELATED APPLICATION

This application claims the benefit of U.S. Provisional Patent Application Ser. No. 61/773,474, filed on Mar. 6, 2013, which is hereby incorporated in its entirety.

BACKGROUND

The present subject matter generally relates to an actuator for powered actuation of a rotary latch of the type having a catch and a release pawl. Rotary latches are used wherever an enclosed compartment or space is accessible through a movable door or cover. This encompasses a wide variety of situations such as vehicle doors, storage container doors, building access doors and the like. The rotary latch is typically fixed to a stationary frame portion of the compartment where it is releasably engageable with a striker such as bolt, post or pin which is mounted on the movable closure member such as a door or cover.

More particularly the present subject matter relates to improvements in providing electromechanical actuation of rotary latches of the general type that employ at least one catch that is releasably retained in a latched position by a pawl. The catch and the pawl extend principally within a primary plane and pivot about separate parallel-extending axes that are perpendicular to the primary plane. One or more torsion springs extend principally within a secondary plane located adjacent to the primary plane and extending parallel thereto. The torsion spring has a first hook that extends out of the secondary plane into the primary plane where it engages the catch to bias the catch away from its latched position toward its unlatched position. The torsion spring also has a second hook that extends out of the secondary plane into the primary plane where it engages the pawl to bias the pawl away from its catch-releasing position toward its catch-retaining position. The catch and the pawl have engageable formations that cooperate to enable the pawl to retain the catch in, and to release the catch from, the latched position by pivoting the pawl into and out of the catch-retaining position. A rotary latch of this general type is disclosed in U.S. Pat. No. 6,471,260, the disclosure of which is incorporated herein by reference.

Various mechanisms can be provided for actuating the pawl by working against the torsion spring to move the pawl to the catch-releasing position. Often these are purely mechanical devices but powered actuators are also known. Many of the powered actuators are needlessly complex and often require modification of the catch and pawl design. There is therefore a need for a rotary latch that is simple in construction and readily adaptable to existing latch constructions.

SUMMARY

The present invention provides a number of improvements relating to rotary latches of the general type disclosed in the above-referenced patent, including a way in which a powered actuator acts directly on the pawl. The axis of rotation of the final member of the gear train is concentric with the axis of rotation of this pawl. An essential feature of a rotary latch, whether the latch is electromechanical or purely mechanical, is to allow a manual (non-electric) means to release the latch. The way the present invention drives the primary pawl allows this functionality without an additional part.

Non-electromechanical versions of rotary latches have at least one spring by necessity. It is a necessity for an electromechanical latch to leave the latching members in a state where they can latch when the striker re-enters the catch area. The present invention makes it possible for this existing spring to back drive the mechanism after the motor releases the catch. This is referred to as self-return action.

Self-return action is more difficult with controllers that short the motor terminals together when the motor is not powered (this is often referred to as dynamically braking the motor). The present invention is able to provide self-return action under this common circumstance.

Note that there are many variations in release spring rates for various applications. For lighter springs the present invention has a provision for a supplemental spring on the idler gear that drives the final output gear.

Again the present invention requires very minimal modification to the base mechanical-only latch as the housing is located on one or more of the posts or shafts of a non-electromechanical latch In one form of the present invention, a rotary latch includes a catch and a pawl that are mounted for limited pivotal movement about separate parallel axes. The catch is pivotal between a latched position and an unlatched position, and the pawl is pivotal between a catch-retaining position and a catch-releasing position. When the pawl is in the catch-retaining position a catch-engageable abutment of the pawl is engageable with a pawl-engageable notch of the catch to retain the catch in the latched position. When the pawl is in the catch-releasing position the catch-engageable abutment of the pawl disengages the pawl-engageable notch of the catch and thereby permits the catch to pivot from the latched position to the unlatched position. The catch also includes striker-engageable jaws adapted to latchingly engage a striker when the catch is in the latched position, and to release the striker for movement toward and away from the catch when the catch is in the unlatched position. The catch-engageable abutment, the pawl-engageable notch and the striker-engageable jaws all extend within a primary plane that is substantially perpendicular to the parallel-extending axes about which the catch and the pawl pivot.

The rotary latch also includes biasing means for biasing the catch away from the latched position toward the unlatched position, and for biasing the pawl away from the catch-releasing position toward the catch-retaining position. The biasing means includes at least one torsion spring having at least one torsion spring coil that surrounds at least one of the parallel-extending axes. The torsion spring coil is located within a secondary plane located adjacent and parallel to but spaced from the primary plane of the catch and pawl. A pair of hooks are formed in the peripheral portions of the torsion spring coil and establish a connection between the torsion spring and the catch and the pawl. The hooks extend transversely from the secondary plane into the primary plane.

The rotary latch includes a gear train having an output gear mounted for rotation about the same axis as the pawl. The gear train includes a motor and pinion driving a bevel gear and pinion. The bevel gear pinion engages an idler which in turn engages the output gear. With this minimal gear train the torsion spring may be sufficient to effect self-return action on the gear train. If a selected torsion spring is not sufficient by itself to effect self-return, a supplemental spring may be added to the gear train to assure self-return action.

BRIEF DESCRIPTION OF THE DRAWINGS

FIG. 31A is a circuit diagram showing the addition of a diode to the motor drive circuit.

FIG. 31B is an alternate circuit diagram showing the addition of a diode to the motor drive circuit.

DETAILED DESCRIPTION

FIGS. 1-4 illustrate one embodiment of an electromechanical rotary latch of the present invention. The rotary latch is shown generally at 1. It will be understood that the rotary latch is incorporated in another structure (not shown), such as the stationary frame around a vehicle door or a storage box door. One of the advantages of the rotary latch 1 is that it can be incorporated in existing doors which had been designed for a non-electromechanical latch without requiring modification of the door or the handle and lock mechanism.

Figure 28:
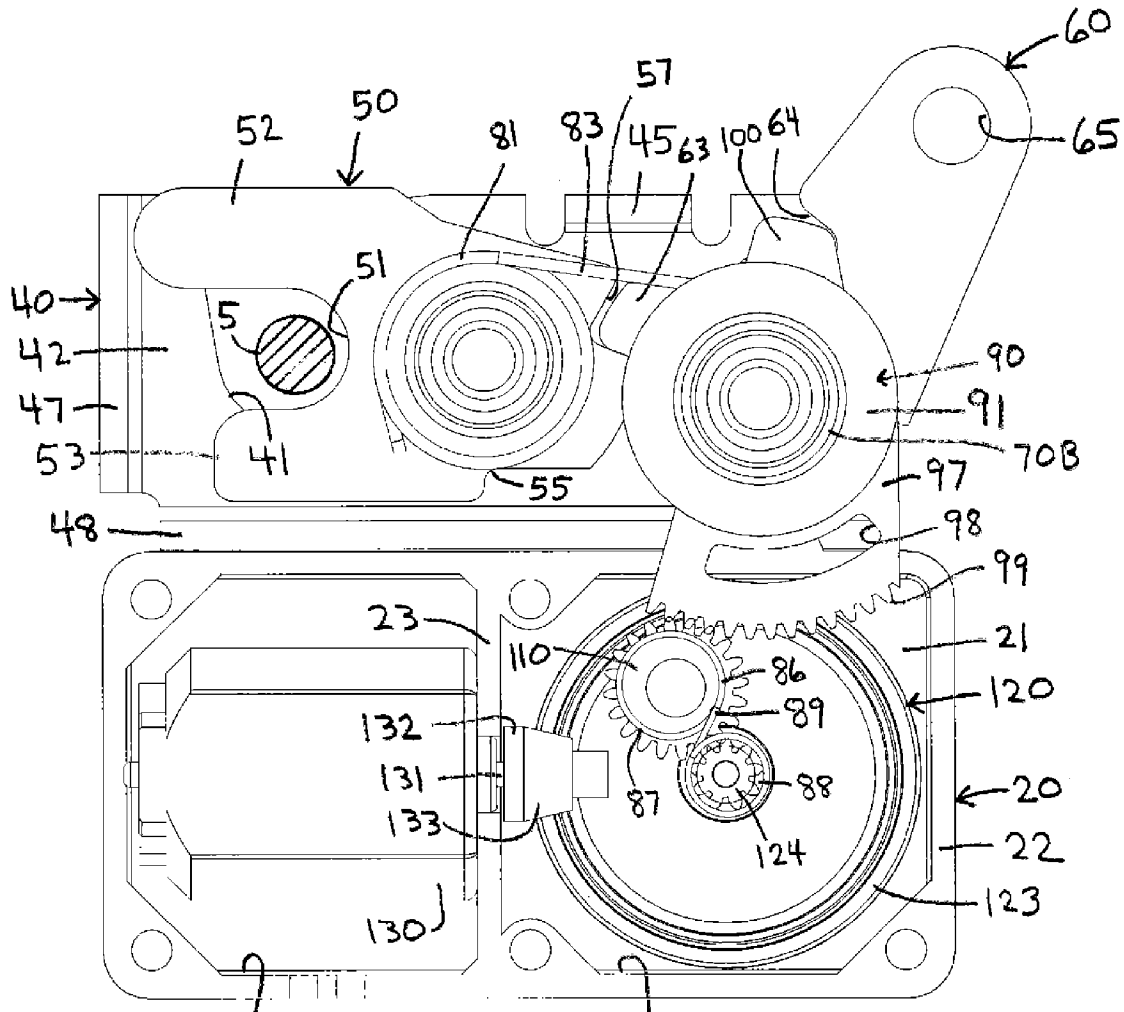
FIG. 28 is a front elevation view of the actuator with the flat plate and housing base removed to illustrate the gear train with the catch in the latched position and the pawl in the catch-retaining position.

The rotary latch 1 includes three major sub-assemblies, namely, a housing, latch members, and a gear train. The housing and latch members are visible in FIGS. 1-4 while most of the gear train is hidden inside the housing and thus is best seen in FIG. 28. Looking first at FIGS. 1-4, the housing includes a base 10, a cover 20, a flat plate 30 and a bent plate 40. These components mount the latch members which include a catch 50, pawl 60, upper and lower posts 70A and 70B, and a spring 80. Turning to FIG. 28, it can be seen that the gear train includes an output gear 90, an idler gear 110, a bevel gear 120 and an electric motor 130 with a bevel pinion. The housing mounts the posts 70A, 70B and the posts in turn mount the catch and pawl respectively for rotary motion thereon. The housing also encloses the gear train in a manner that allows the gear train to drive the pawl to a catch-releasing position, as will be described below.

It will be understood that while the housing shown in this embodiment is made in four parts, other arrangements of the housing are possible. For example, while the flat plate 30 and bent plate 40 as shown are made of metal, they could be made of plastic to provide an all-plastic construction. Details of the housing components will now be described.

Figure 1:
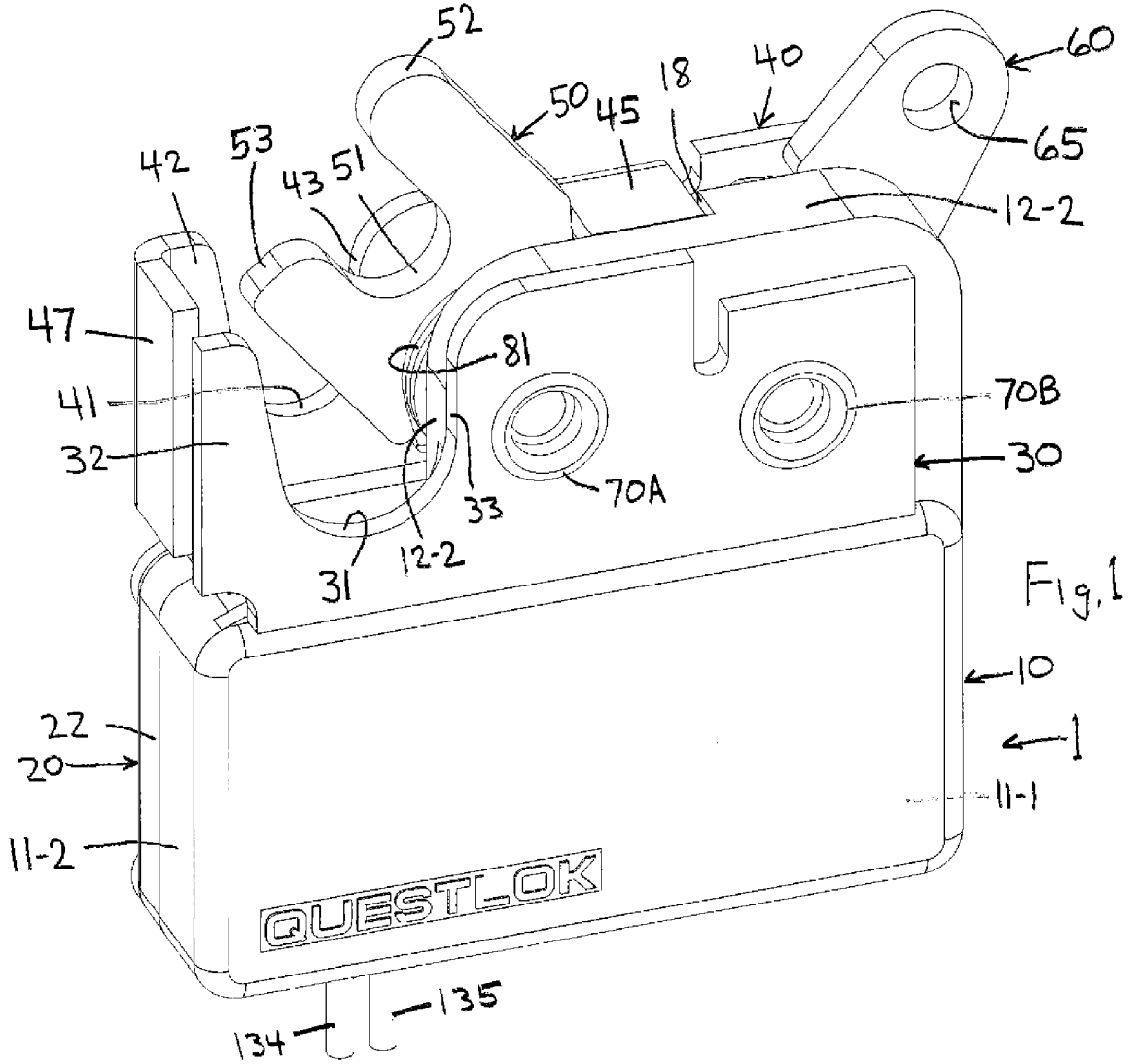
FIG. 1 is a front perspective view of an electromechanical rotary latch according to the present invention, shown with the catch in its released position and the pawl in its neutral position.
Figure 2:
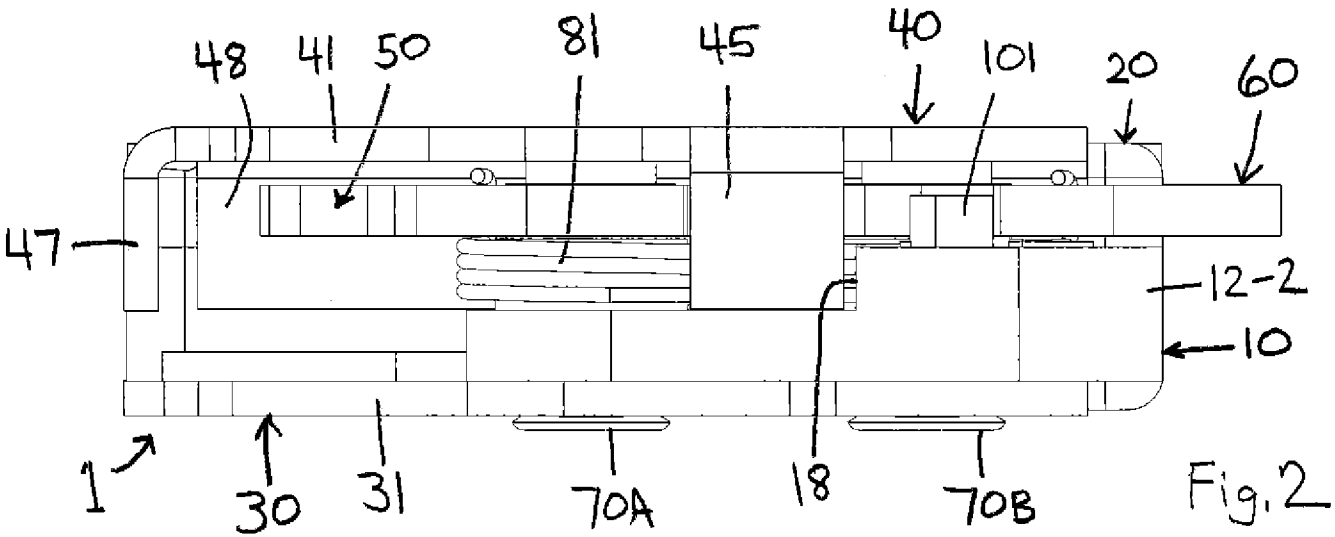
FIG. 2 is top plan view of the latch of FIG. 1.
Figure 3:
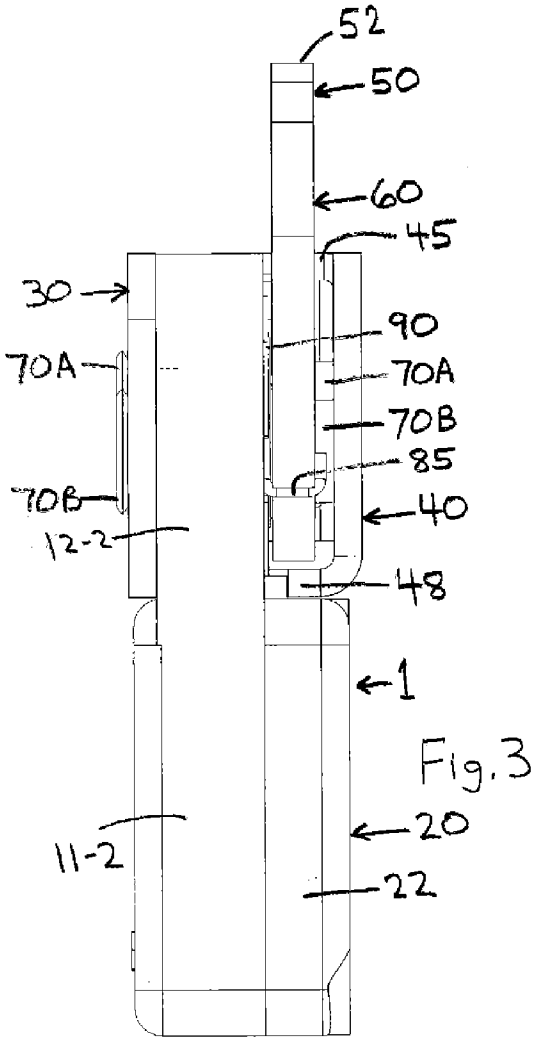
FIG. 3 is a right end elevation view of the latch of FIG. 1.
Figure 4:
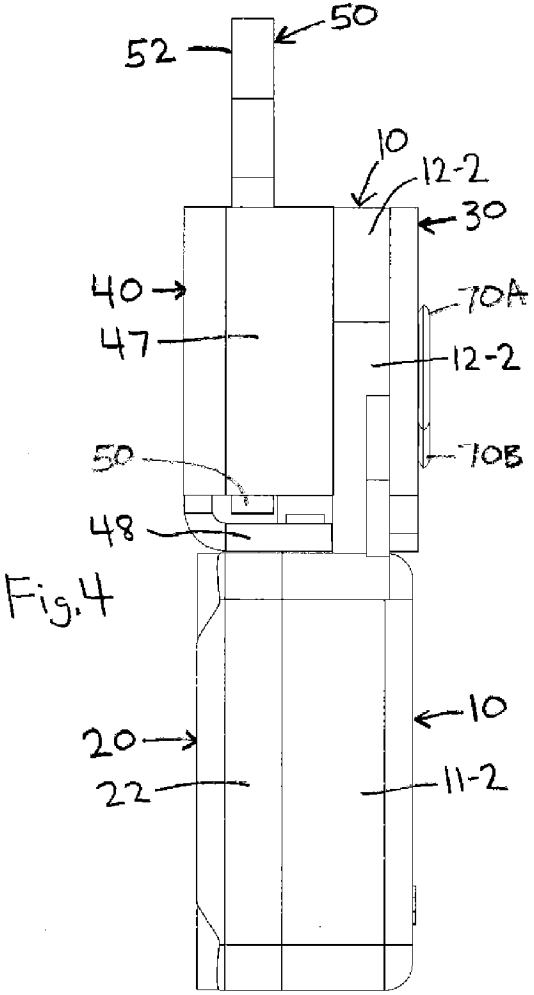
FIG. 4 is a left end elevation view of the latch of FIG. 1.
Figure 5:
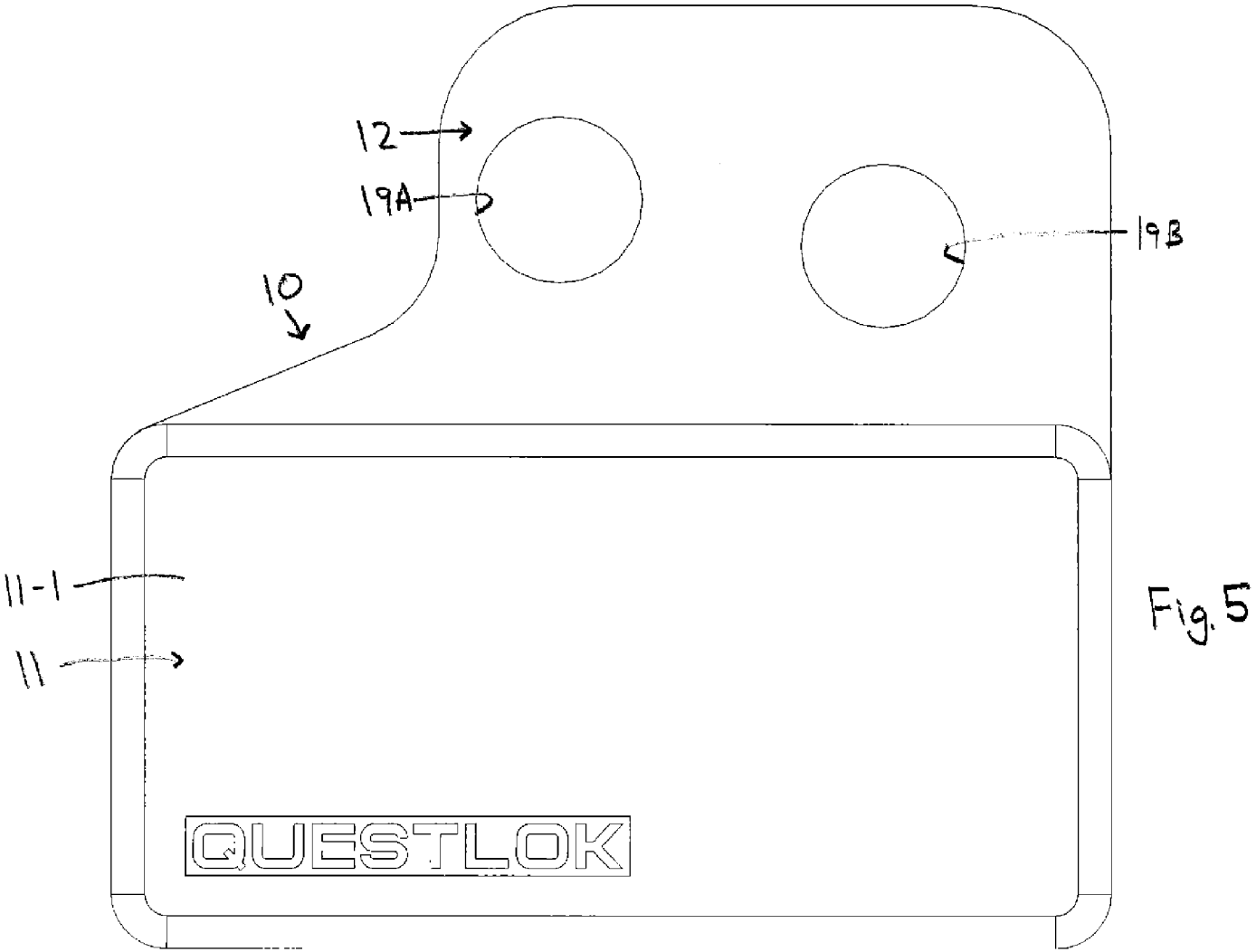
FIG. 5 is front elevation view of the housing base.
Figure 6:
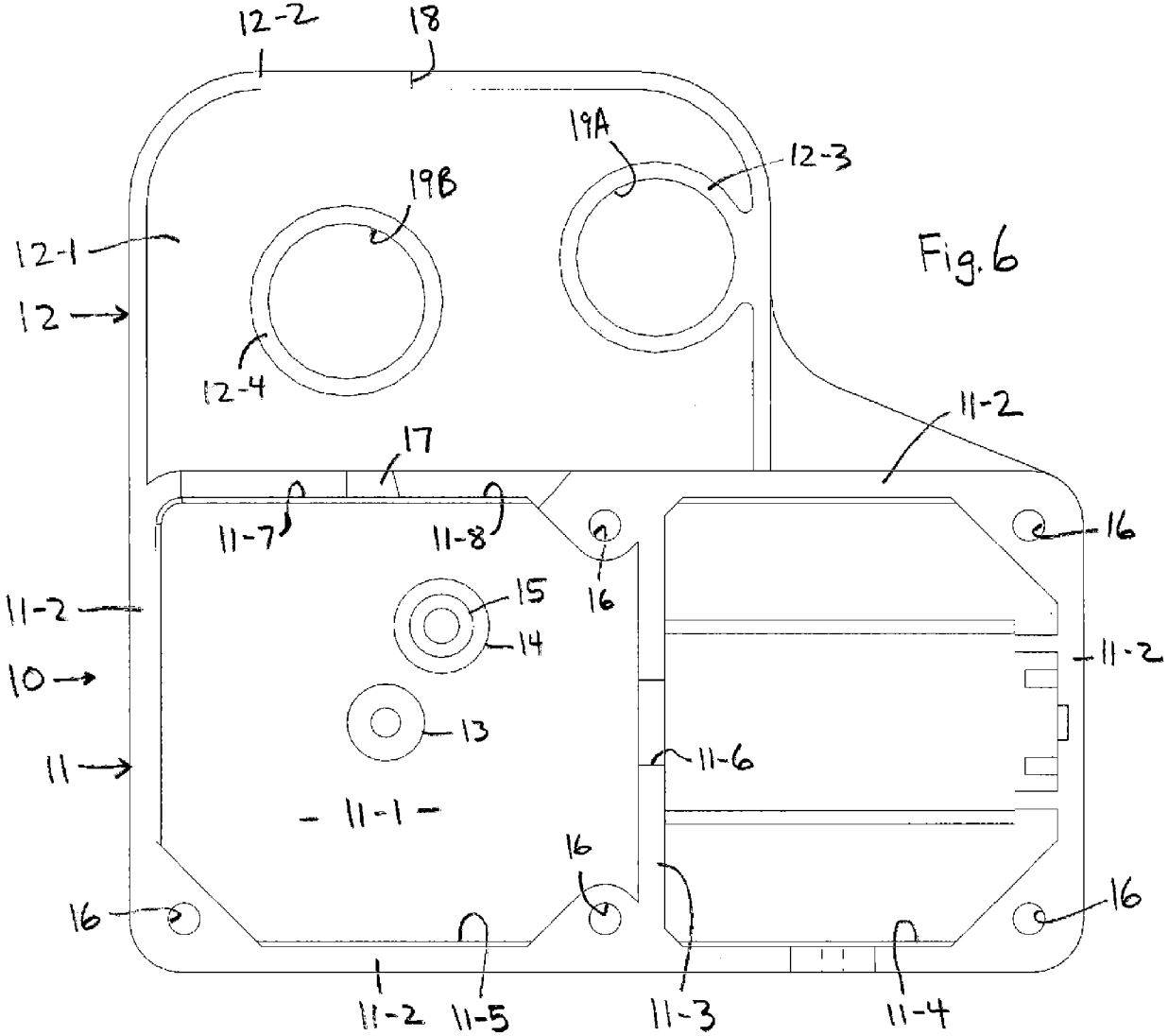
FIG. 6 is a rear elevation view of the housing base, looking at the interior thereof.
Figure 7:
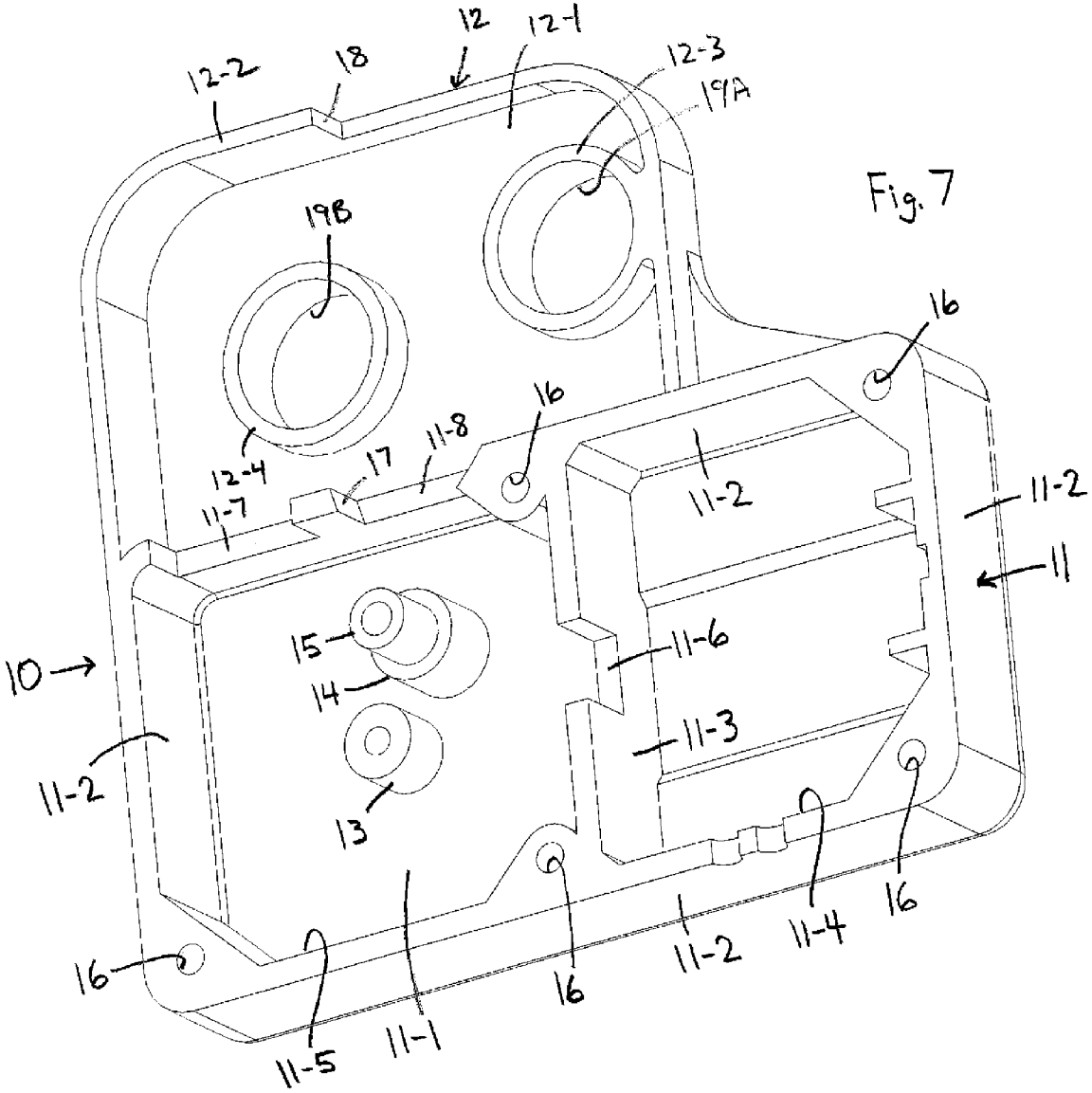
FIG. 7 is a perspective view of the interior of the housing base.

FIGS. 5-7 illustrate the housing base 10. The base has two major sections, a lower rectangular case 11 and an upper plate 12. The case 11 has a generally planar outer wall 11-1 surrounded by boundary walls 11-2 which extend inwardly from one side of the outer wall 11-1. There is also an intermediate case wall 11-3 which divides the case into two compartments, a motor compartment 11-4 and a gear compartment 11-5. A cutout 11-6 in the intermediate wall allows the motor shaft to extend from the motor compartment into the gear compartment. The gear compartment contains a first hub 13 for mounting a shaft (not shown) which in turn mounts the bevel gear 120 for rotation about the shaft. A second hub 14 has a spindle 15 for rotationally mounting the idler gear 110. Three corners of the case 11 and the two junctions of the intermediate wall 11-3 and outer wall 11-1 have enlargements which contain apertures 16 for receiving fasteners (not shown) for attaching the cover 20 to the base 10.

A portion of the case boundary wall 11-2 adjoining the gear compartment 11-5 and the upper plate 12 has a pair of cutouts 11-7 and 11-8 which define an upstanding peg 17. The peg is engageable with an internal slot in the output gear 90 to limit the rotational extent of output gear movement. The cutouts 11-7 and 11-8 permit the output gear to extend into the gear compartment 11-5 and adjacent to the upper plate 12. The upper plate 12 has a wall 12-1 which is parallel to but inwardly spaced from the outer wall 11-1 of the case 11. The wall 12-1 is surrounded by a flange 12-2 that extends inwardly from wall 12-1. The flange 12-2 has a portion of reduced height which defines an edge face 18 (FIGS. 6 and 7). Finally, the upper plate 12 has upper and lower openings 19A, 19B which receive the upper and lower posts 70A and 70B, respectively. The openings are surrounded on the interior side of the wall 12-1 by upper and lower annular bushings 12-3 and 12-4. The lower annular bushing 12-4 is sized to receive the central opening of the output gear 90, thereby mounting the output gear for rotation on the lower bushing.

Figure 8:
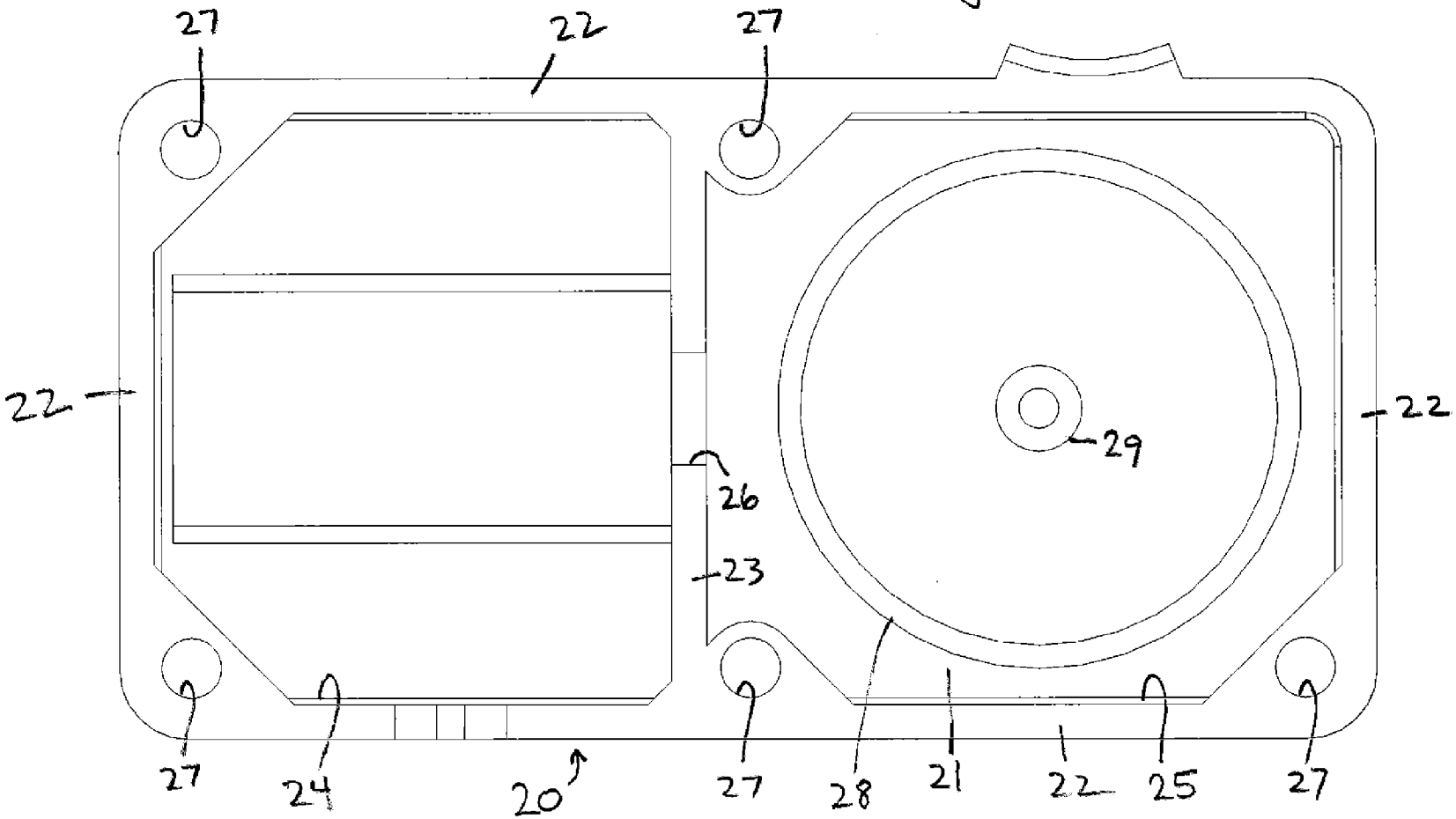
FIG. 8 is a front elevation view of the housing cover.
Figure 9:
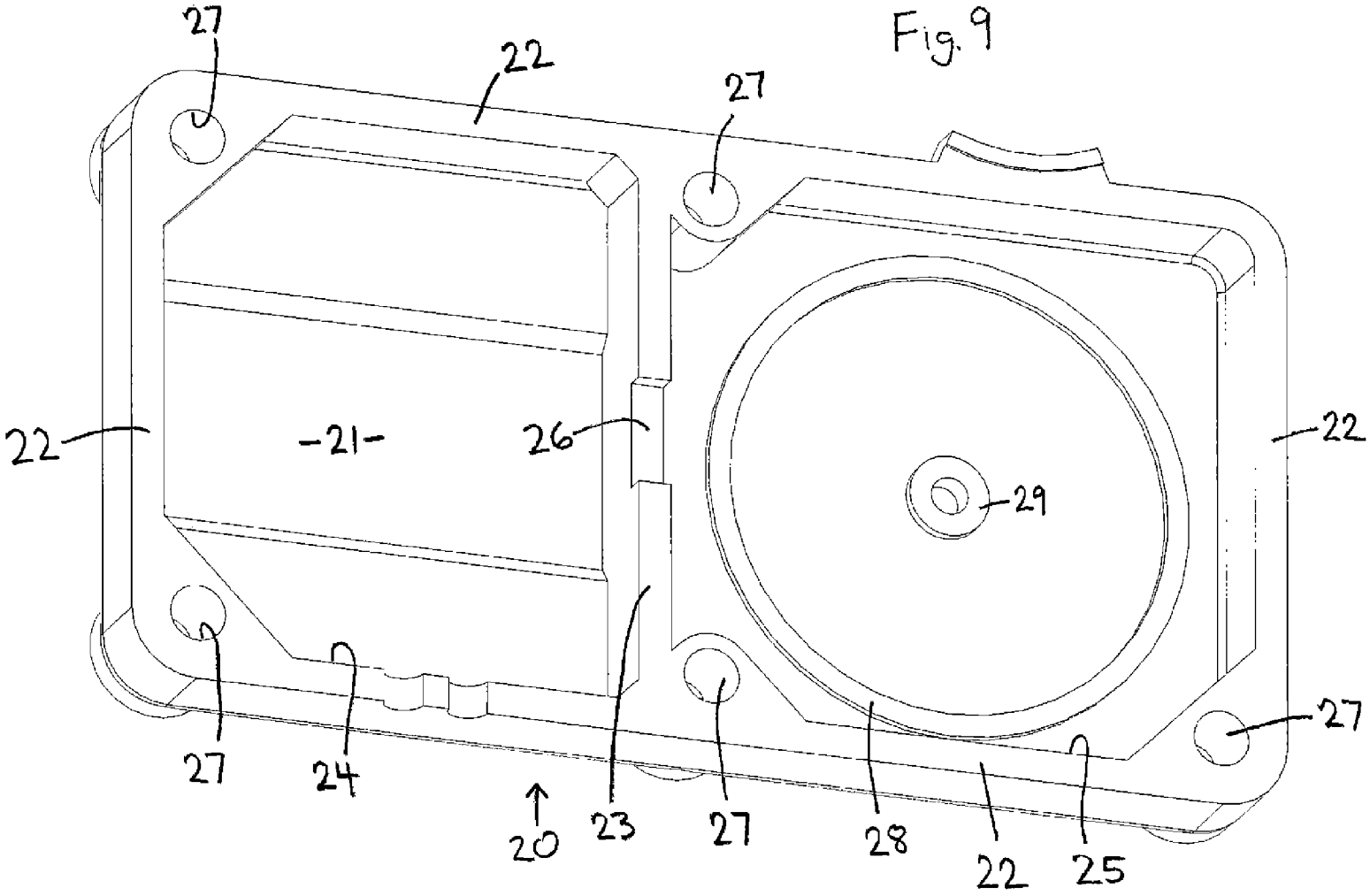
FIG. 9 is a perspective view of the interior of the housing cover.

FIGS. 8 and 9 illustrate details of the interior of the housing cover 20. The cover 20 is sized to mate with the case 11 of the housing base 10. As such the cover has an outer wall 21 which is surrounded by a boundary wall 22. An intermediate wall 23 divides the cover into a motor section 24 and a gear section 25. A cutout 26 provides a mounting location for the motor housing and allows passage of the motor shaft. Enlargements at the corners have apertures 27 which receive the fasteners (not shown) which hold the cover on the case. Together the case and cover define an enclosure for the motor 130 and most of the gear train. An upraised race 28 is formed on the inner face of the outer wall 21 in the gear section 25 to support the bevel gear 120 and its pinion. A hub 29 receives a shaft (not shown) for mounting the bevel gear 120.

Figure 10:
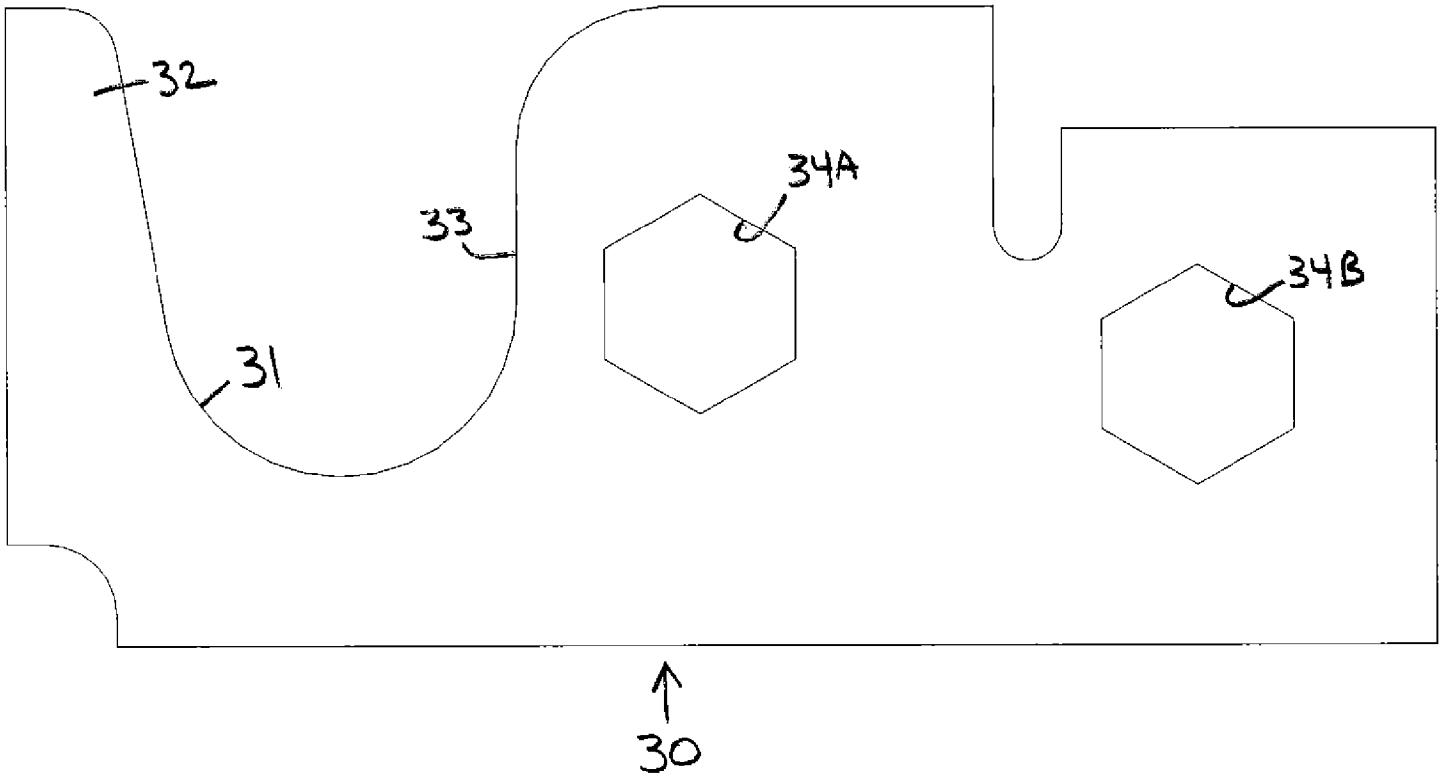
FIG. 10 is a front elevation view of the flat plate.

FIG. 10 shows the flat plate 30. It has a U-shaped slot 31 defined by a standing leg 32 on one side and an edge surface 33 on the other side. Slot 31 will receive a striker when the associated door or cover with which the latch is used is moved to a closed position. The leg 32 will assist in preventing the striker from escaping the catch 50. It will be noted in FIG. 1 that the edge surface 33 is generally aligned with the flange 12-2 of the upper plate 12 on the housing base 10. Accordingly no part of the housing will interfere with the movement of the striker in and out of the slot 31. The flat plate 30 also has upper and lower hexagonal openings 34A, 34B formed therethrough. These openings receive the ends of the upper and lower posts 70A, 70B respectively. The ends of the posts are swaged over the outer face of the flat plate. This retains the flat plate in the position shown in FIGS. 1-4 where it is adjacent to the wall 12-1 of the base's upper plate 12 and above the outer wall 11-1 of the case 11.

Figure 11:
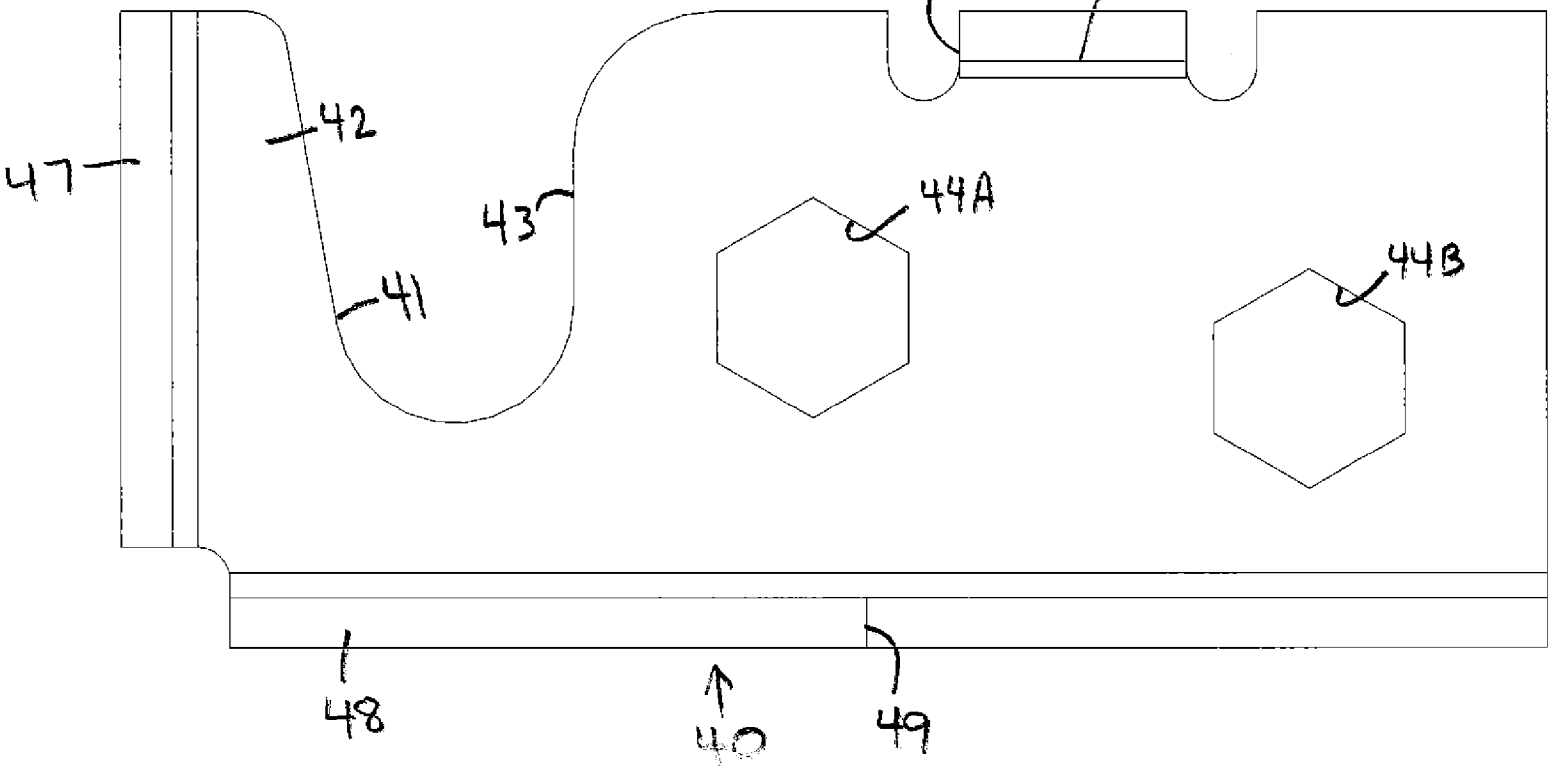
FIG. 11 is a front elevation view of the bent plate.
Figure 12:
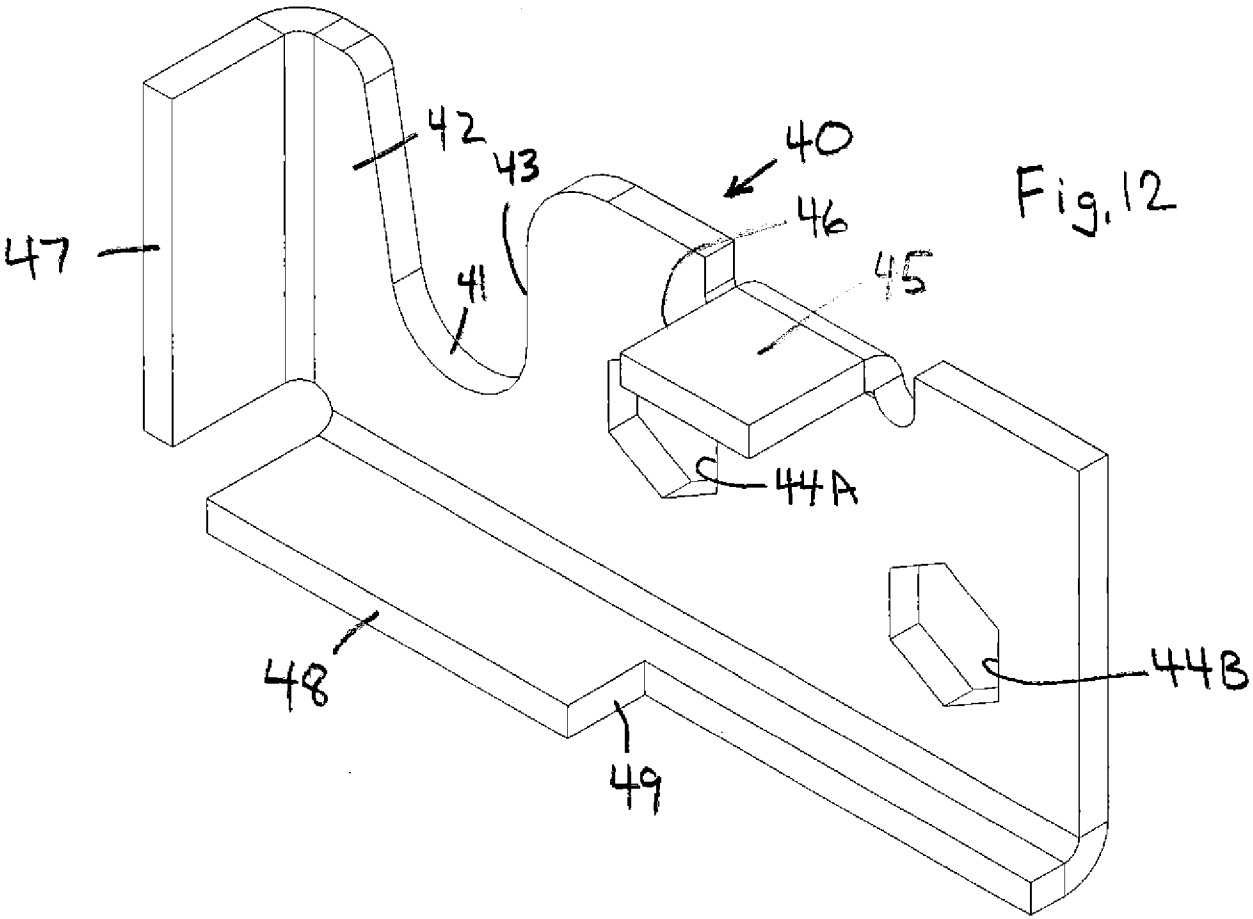
FIG. 12 is a perspective view of the front plate.

FIGS. 11 and 12 show the bent plate 40. It is similar to the front plate 30 in that it has a U-shaped slot 41 defined by a standing leg 42 on one side and an edge surface 43 on the other side. Slot 41 will receive a striker when the door or cover is moved to a closed position. The leg 42 will assist in preventing the striker from escaping the catch 50. Again the edge surface 43 is generally aligned with the flange 12-2 of the upper plate 12 on the housing base 10 so that nothing interferes with the striker. The bent plate 40 also has upper and lower hexagonal openings 44A, 44B formed therethrough. These openings receive the ends of the upper and lower posts 70A, 70B respectively. The ends of the posts are swaged over the rear face of the bent plate 40 to retain the bent plate in the position shown in FIGS. 1-4.

While the bent plate is similar to the flat plate in the foregoing description, there are some additional features found on the bent plate that are not found on the flat plate. These include three extensions out of the plane of the bent plate at the top, end and bottom edges. An upper tab 45 forms a stop face 46 for the catch. An end tab 47 encloses the area where the catch moves. And a lower tab 48 is located near the top edge of the housing cover 20. A step 49 in the lower tab provides clearance for the output gear 90.

Figure 13:
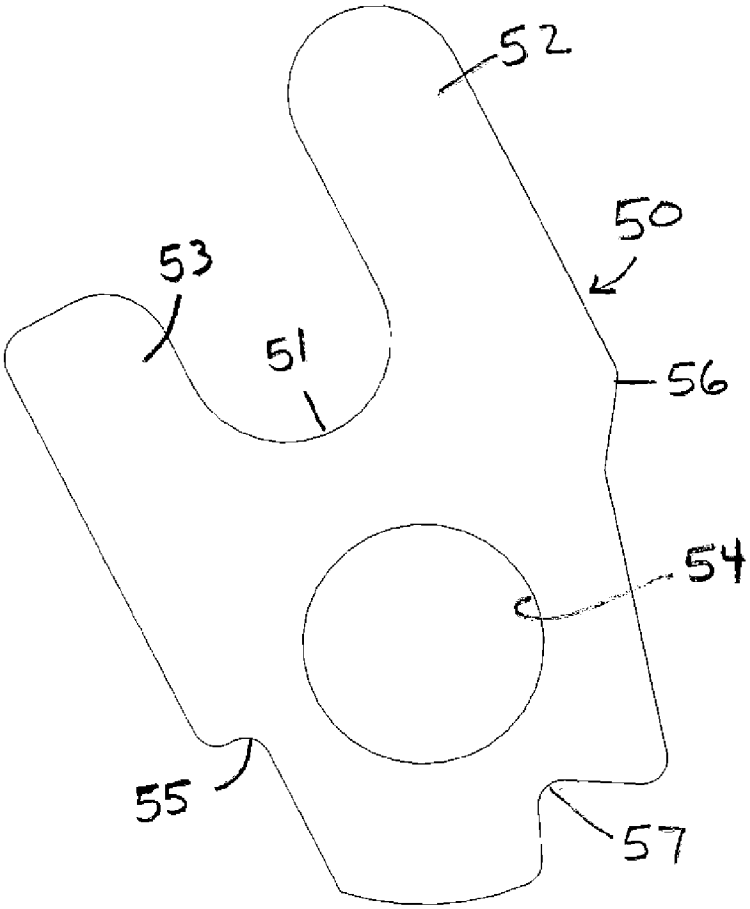
FIG. 13 is a front elevation view of the catch.

FIG. 13 illustrates the catch 50. The primary feature of the catch is a U-shaped slot 51 defined by an upper jaw 52 and a lower jaw 53. An opening 54 permits the catch to be mounted for rotation on the upper post 70A. A notch 55 receives a hook on the spring 80 so that the spring biases the catch to an unlatched position. In the orientation of FIGS. 13 and 28-30 the spring 80 biases the catch 50 in a clockwise direction about the center of opening 54. A stop face 56 is engageable with the stop face 46 of the upper tab of the bent plate to limit rotation of the catch under the influence of the spring 80. The catch 50 also has a pawl-receiving notch 57. Receipt of the pawl in the notch 57 prevents rotation of the catch.

Figure 14:
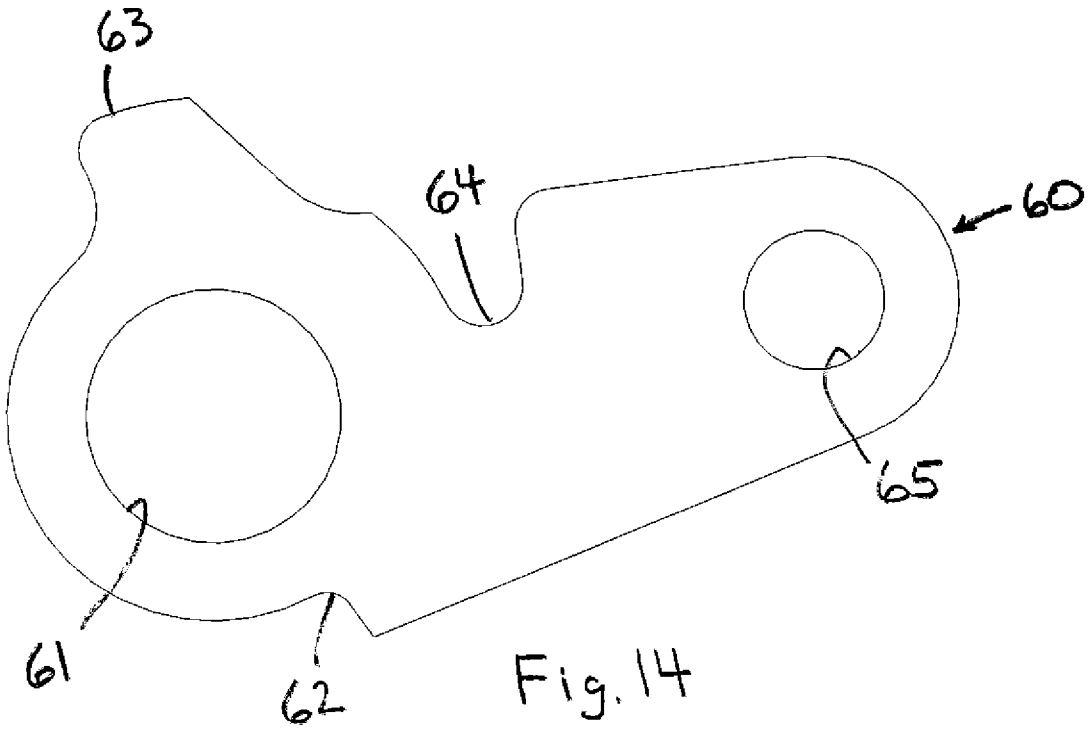
FIG. 14 is a front elevation view of the pawl.
Figure 29:
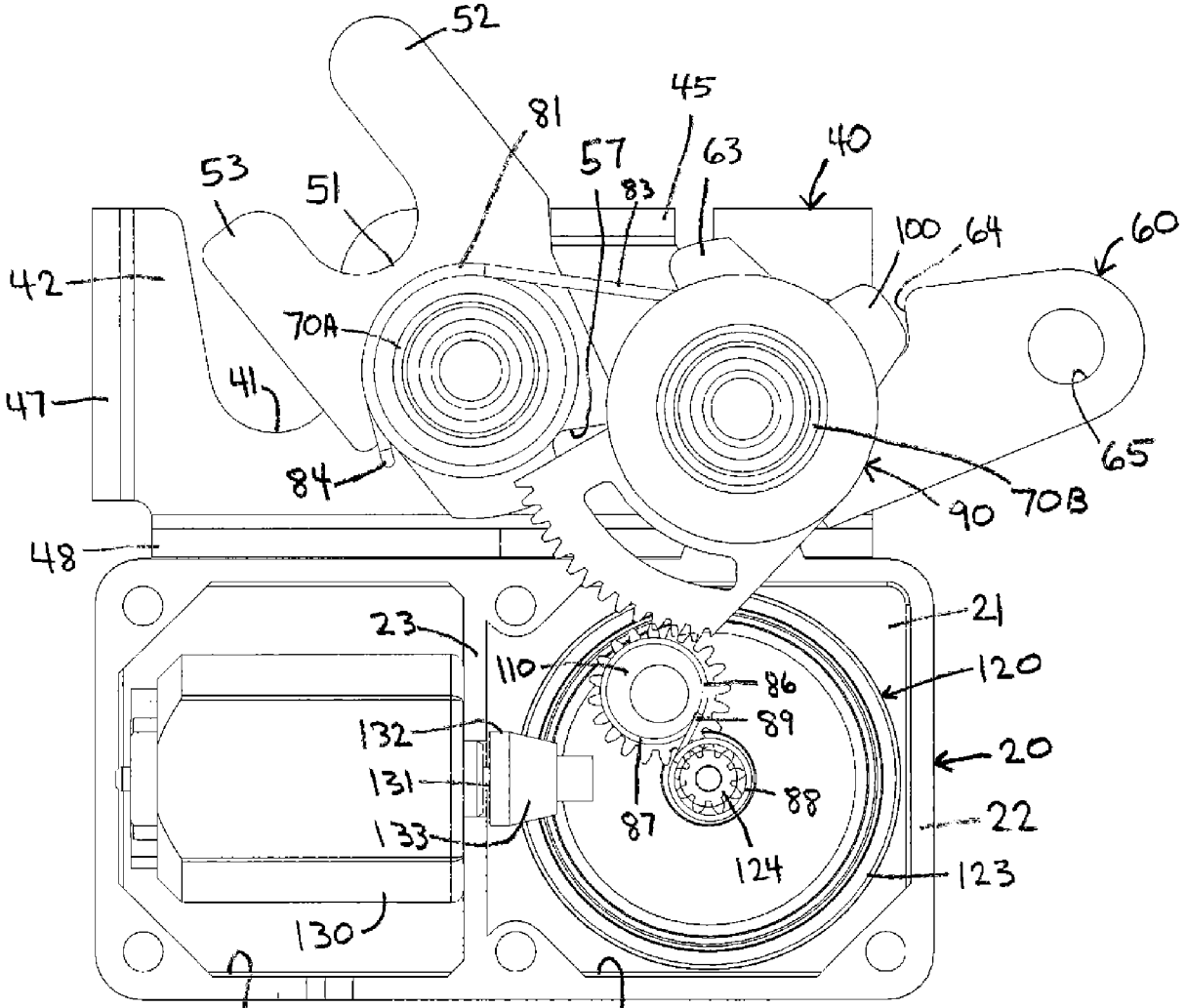
FIG. 29 is a front elevation view of the actuator with the flat plate and housing base removed to illustrate the gear train with the catch in the unlatched position and the pawl in the catch-releasing position.

FIG. 14 shows the pawl 60. It has an opening 61 sized to fit on the lower post 70B to mount the pawl for rotation. A notch 62 receives a hook on the spring 80 so that the spring biases the catch to a catch-retaining position. In the orientation of FIGS. 14 and 28-30 the spring 80 biases the pawl 60 in a counterclockwise direction about the center of the opening 61. The pawl has an abutment 63 that is releasably engageable with the pawl-receiving notch 57 of the catch. When the abutment engages the notch 57 as seen in FIG. 29 it prevents rotation of the catch 50 to its unlatched position. There is also a slot 64 that receives a lug on the output gear 90 to allow the output gear to rotate the pawl clockwise. The pawl also has an eye 65 near its outer end. The eye may be used to connect a suitable mechanical unlatching apparatus, such as a link, lever or rod (not shown).

Figure 15:
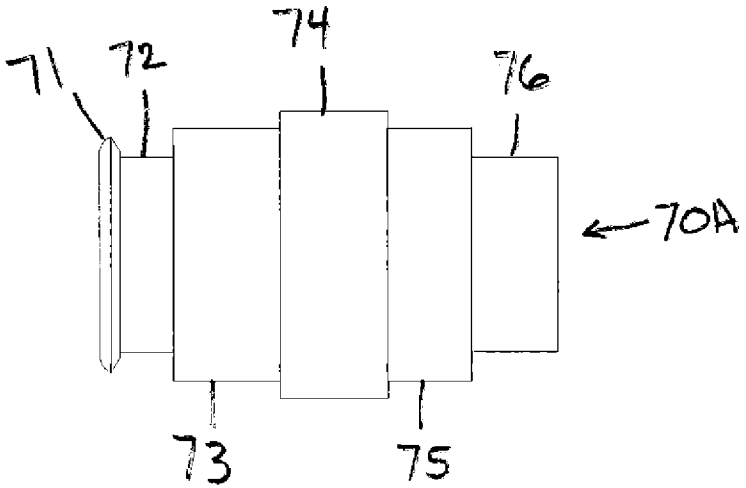
FIG. 15 is a side elevation view of a mounting post.

FIG. 15 shows the upper post 70A. The lower post 70B is identical. The front or forward end of the post has a flange 71 which can be swaged over the outer face of the flat plate 30. Working from the flange 71 toward the rear of the post, there are a series of five shoulders 72, 73, 74, 75 and 76. The shoulders have stepped outer diameters, with the central shoulder 74 being the largest, the intermediate shoulders 73, 75 having a reduced outer diameter compared to the central shoulder 74, and the outer shoulders 72, 76 having the smallest outer diameter, as shown in FIG. 15. Outer shoulder 72 is sized to receive the hex opening 34A of the flat plate 30. The flat plate abuts against the intermediate shoulder 73. Intermediate shoulder 73 receives the upper opening 19A of the housing base's upper plate 12. The upper plate abuts against the central shoulder 74. One of the spring coils surrounds the central shoulder 74. The second intermediate shoulder 75 receives the opening 54 of the catch (on the lower post 70B the second intermediate shoulder would receive the opening 61 of the pawl 60). The catch abuts against the central shoulder 74. Finally, the second outer shoulder 76 receives the hex opening 44A of the bent plate 40. The bent plate abuts against the second intermediate shoulder 75.

The interior of the post 70A has a bore through its center with a larger counterbore in the area of the outer shoulders 72 and 76. At least the counterbore portion has internal threads. These threads may be used to mount the rotary latch on the frame of the compartment with which the latch is used.

Figure 16A:
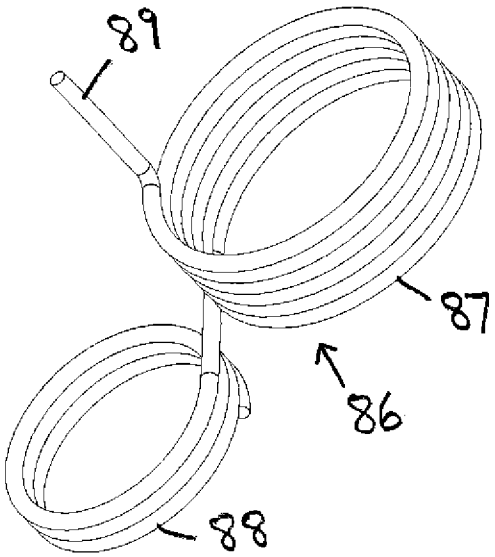
FIG. 16A is a perspective view of a supplemental spring.
Figure 16:
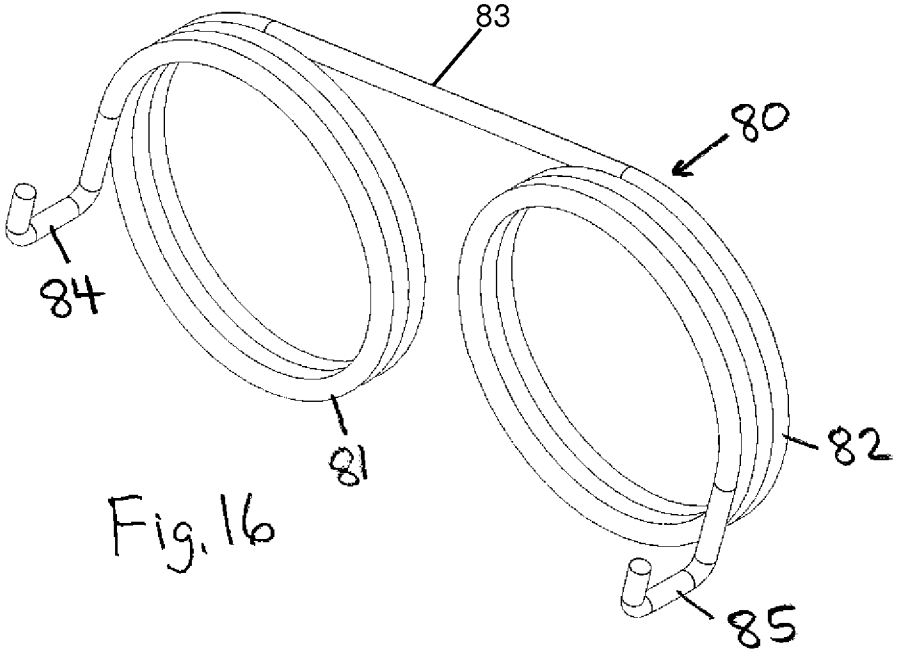
FIG. 16 is a perspective view of the torsion spring.
Figure 20:
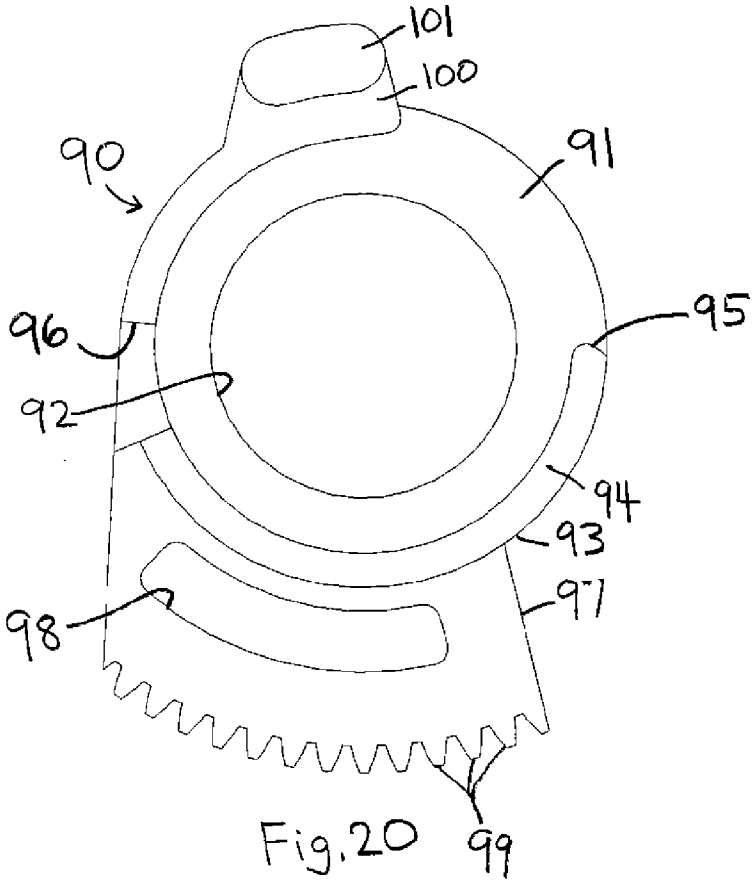
FIG. 20 is a rear elevation view of the output gear.
Figure 17:
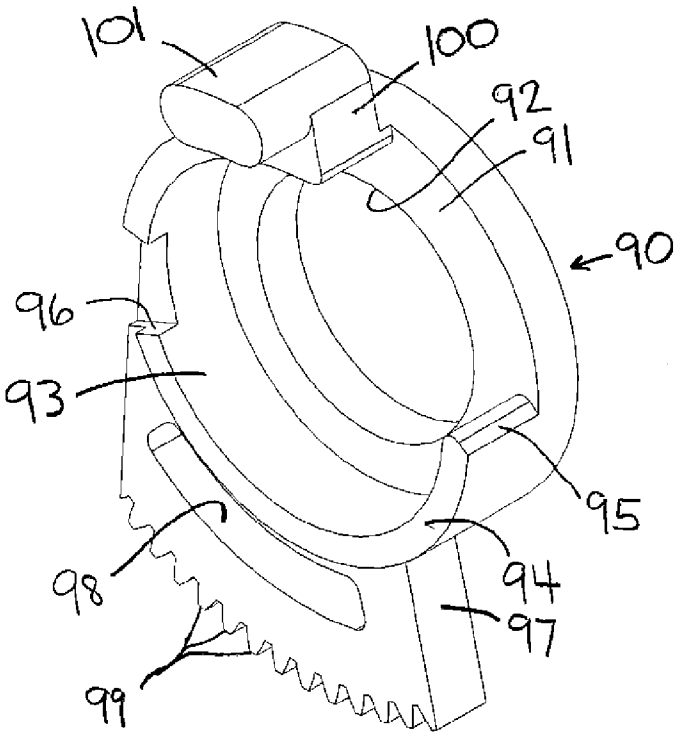
FIG. 17 is a rear perspective of the output gear.
Figure 19:
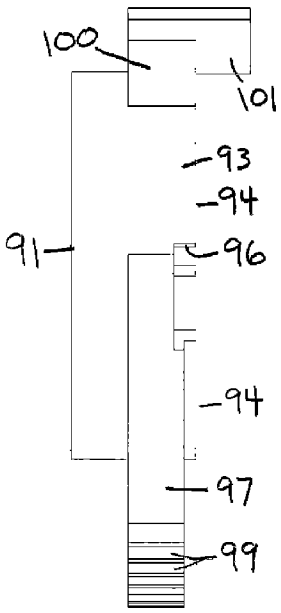
FIG. 19 is a right elevation view of the output gear.
Figure 22:
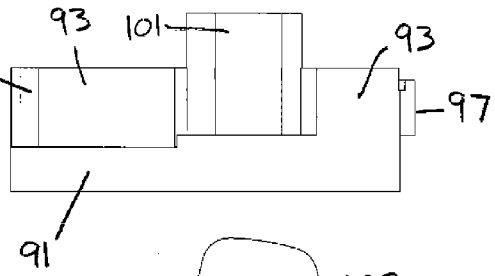
FIG. 22 is a top plan view of the output gear.
Figure 18:
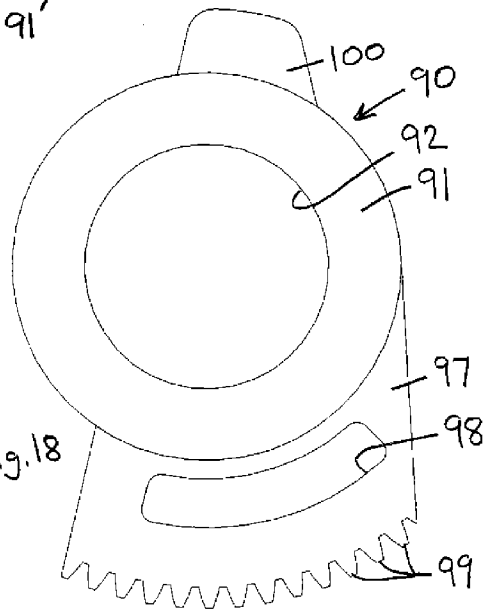
FIG. 18 is a front elevation view of the output gear.
Figure 23:
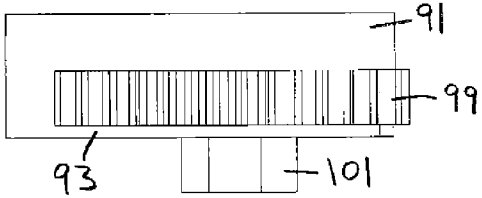
FIG. 23 is a bottom plan view of the output gear.
Figure 21:
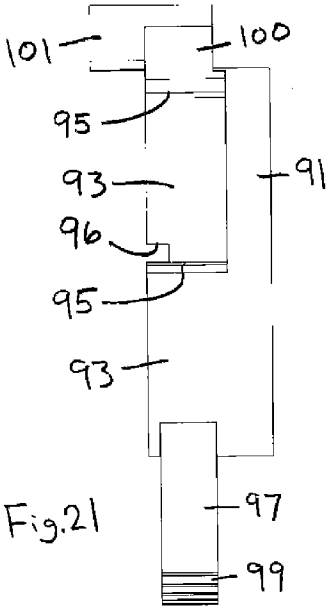
FIG. 21 is a left elevation view of the output gear.

FIG. 16 illustrates the spring 80. The spring has first and second coils 81 and 82. The coils 81 and 82 are connected by a bridge member 83. Coil 81 terminates at a hook 84 which extends from the coil 81 to engage the catch notch 55. Coil 82 terminates at a hook 85 which extends from the coil 82 to engage the pawl notch 62. The hooks 84, 85 enable the coils 81, 82 to bias the catch 50 and pawl 60 as described above.

FIGS. 17-23 illustrate the output gear 90. The output gear has a circular ring 91 with a central circular opening 92. The opening 92 is sized to fit around the lower bushing 12-4 of the upper plate 12. Thus, the output gear is mounted for rotation not on the post 74B but on the housing base's upper plate 12. An axially extending sleeve 93 is mounted on the rear face of the ring 91 at its outside diameter. The outer diameter of the sleeve 93 matches that of the ring 91 but the sleeve's inside diameter is larger than the diameter of the opening 92. Thus the radial thickness of the sleeve is less than that of the ring. The sleeve 93 terminates at a top land 94. The inside diameter of the sleeve is large enough to accommodate the lower coil 82 of the spring 80. It will be noted that the sleeve 93 is not a complete annulus as it has a hiatus at 95. The hiatus permits passage of the spring's bridge member 83. Further, there is a notch 96 in the top land that permits passage of the spring hook 85.

Adjacent the notch 96 is an arcuate extension 97. The arcuate extension is axially located just below the top land 94 of the sleeve 93. An arcuate slot 98 is formed through the thickness of the extension 97. This slot 98 engages the peg 17 of the housing base, thereby providing limits on the arcuate rotation of the output gear. The outer edge of the extension carries gear teeth 99. Approximately on the opposite side of the sleeve 93 from the extension 97 there is an ear 100 that extends radially beyond the outer diameter of the ring 91 and sleeve 93. The ear 100 mounts an axially-extending lug 101. It can be seen that the lug 101 extends axially beyond the top land 94 of the sleeve 93. This axial extension permits the lug to engage the slot 64 in the pawl 60.

Figure 25:
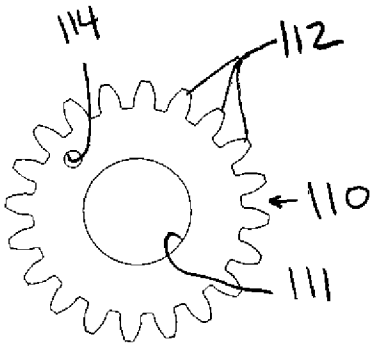
FIG. 25 is a front elevation view of the idler gear.
Figure 24:
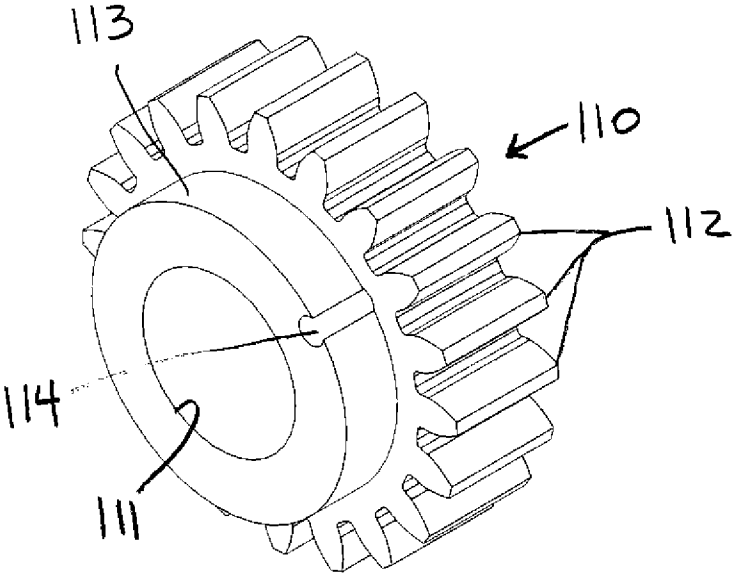
FIG. 24 is a perspective view of the idler gear, on an enlarged scale.

Turning now to FIGS. 24-25, the idler gear 110 is shown. It has a central opening 111 which is sized to receive the spindle 15 but not the second hub 14 of the housing base's case 11. Thus, the idler gear rotates about the spindle 15, supported on the second hub 14. The idler gear is thus axially constrained in the space between this second hub and surface 121 of the bevel gear. A plurality of spur gear teeth 112 extend from the main body of the gear. An upstanding boss 113 is formed on one side of the gear. It extends axially from the main body of the gear. The boss 113 has an axial, cylindrical seat 114 drilled through it. This seat 114 can receive one end of a supplemental spring.

Figure 30:
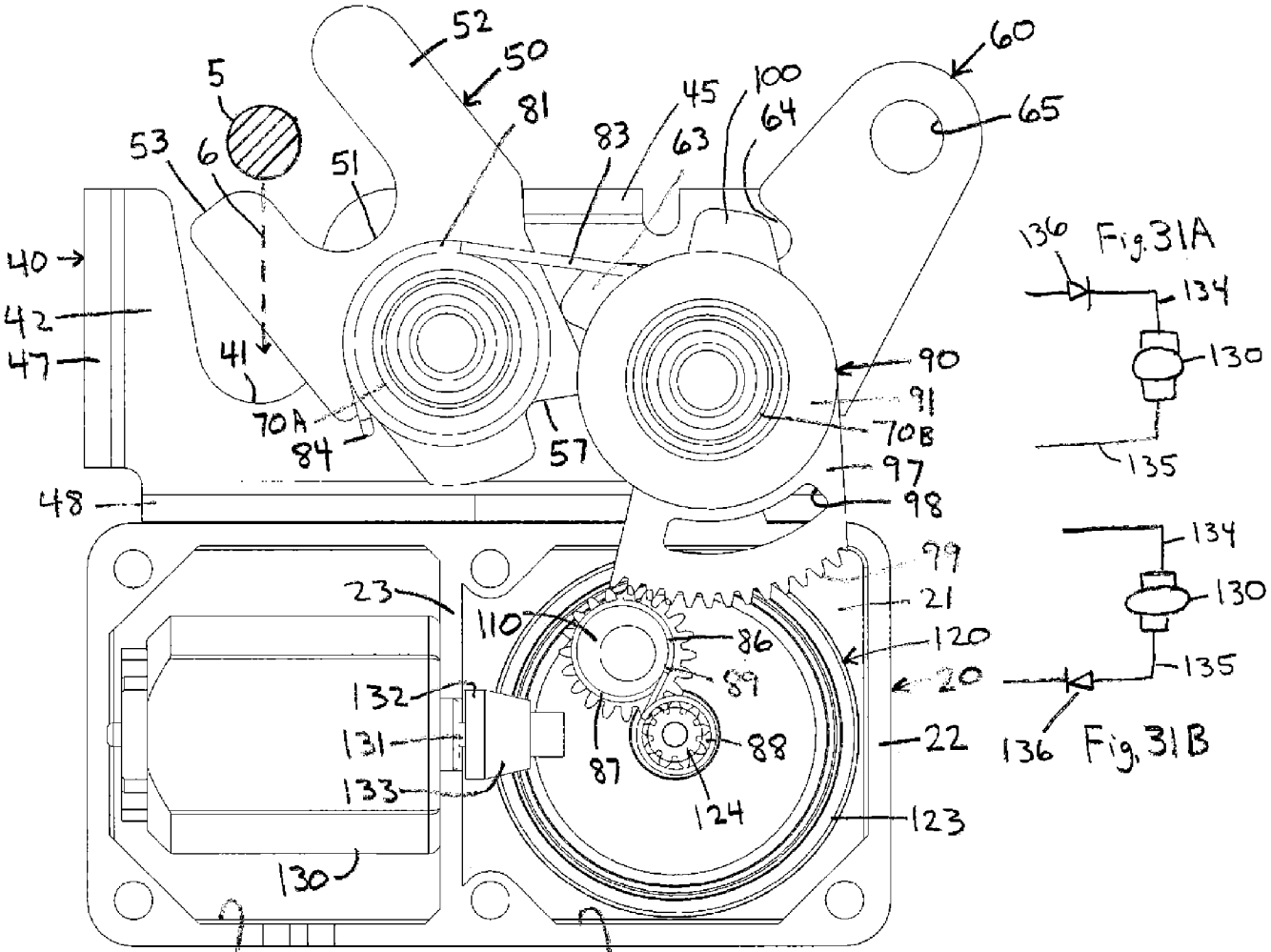
FIG. 30 is a front elevation view of the actuator with the flat plate and housing base removed to illustrate the gear train with the catch in the unlatched position and the pawl in the neutral position.

FIG. 16A illustrates a supplemental spring 86. It has a first coil 87 joined to a second coil 88. The first coil 87 terminates at an axially-extending leg 89. As seen in FIGS. 28-30, the supplemental spring may be incorporated in the gear train to provide an assist to the self-return feature. The first coil 87 surrounds the second hub 14 of the housing base. Thus, it is in front of the idler gear 110 which sits behind the second hub 14 on the spindle 15. The leg 89 fits into the seat 114. The second coil 88 surrounds the first hub 13. The second coil serves as a spacer to help the spring better fill its space and prevent the leg 89 from coming out of the seat 114 of the idler gear 110.

The supplemental spring 86 can be used to drive the gear train and pawl to the neutral position (if the catch is in its unlatched position) and to the catch-retaining position (if the catch is driven by a striker to the latched position). The supplemental spring 86 is used in the event the main spring 80 does not provide sufficient return force to drive the gear train and pawl to the catch-retaining position. It will be understood that different applications of the rotary latch may demand different spring rates of the main spring 80. When a weaker main spring 80 is preferred, its return force is given a boost with a supplemental spring 86, thus assuring a self-return feature for the rotary latch. This means the motor does not have to be activated to drive the pawl to the catch-retaining position.

Figure 26:
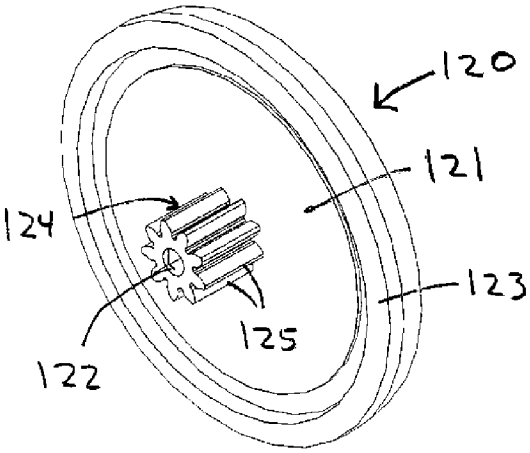
FIG. 26 is a perspective view of the bevel gear and pinion.
Figure 27:
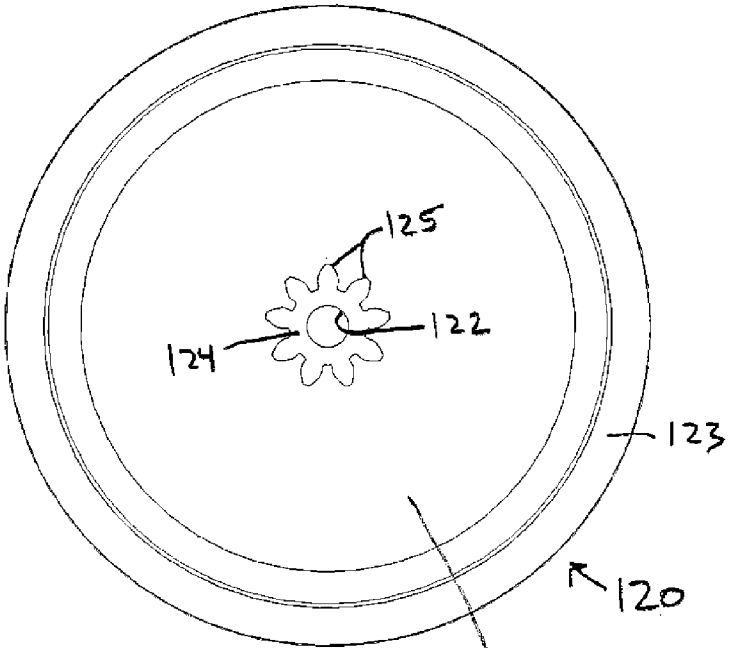
FIG. 27 is a front elevation view of the bevel gear and pinion.

The next component of the gear train is the bevel gear 120, as shown in FIGS. 26-27. The bevel gear has a main body portion 121 with a central opening 122 therethrough. The opening 122 is sized to receive a shaft (not shown) for rotation on the shaft. The ends of the shaft are mounted in the first hub 13 of the housing case and the hub 29 of the housing cover. The perimeter of the bevel gear 120 carries bevel gear teeth, shown schematically at 123. Integrally formed on the center of the body portion 121 is a pinion 124. The pinion has spur gear teeth 125.

FIG. 28 illustrates the final components of the gear train. These include an electric motor 130 having a drive shaft 131 on which is mounted a pinion 132. The pinion 132 carries bevel gear teeth shown schematically at 133. The motor 130 is mounted in the motor compartment 11-4 of the housing case 11 and the motor section 24 of the housing cover. A portion of the motor housing fits in the cutout 11-6 of the intermediate wall 11-3 in case 11. Suitable electrical wires 134, 135 (FIG. 1) are provided for supplying electric power to the motor. The motor shaft extends through cutout 11-6 into the gear compartment 11-5.

FIGS. 31A and 31B illustrate alternate motor drive circuits that include a diode 136. In this circuit voltage+ with respect to wire 134 moves the motor 130 to release the catch. That is, it activates the gear train so the pawl 60 moves to its catch releasing position. In the figures shown, this is a clockwise movement about the lower post 70B. The diode 136 can be placed on either side of the motor 130, as illustrated in the two figures. The diode has two advantages. First, it reduces the torque required from the springs to back drive the gears and motor to get the output gear back to where the pawl is in the neutral or catch retaining position. Second, it prevents current from being applied in a direction that is opposite of the direction required to release the latch.

The use, operation and function of the rotary latch are as follows. FIG. 28 shows the rotary latch of the present invention in the latched condition. In this condition a striker 5 is held by the rotary latch. It will be understood that the striker 5, shown here in cross section in the form of a bolt or pin, is fixedly connected to the movable door or cover. The rotary latch is fixedly connected to the door frame. When in the latched condition, the striker 5 extends through the U-shaped slot 31 of the flat plate (not shown here) and U-shaped slot 41 of the bent plate 40. The striker 5 is retained in the slots by the catch 50. As can be seen, in the latched position the jaws 52 and 53 of the catch 50 cooperate with the flat plate and bent plate to prevent movement of the striker 5. The catch 50 cannot rotate out of its latched position because the pawl 60 is in its catch-retaining position. When the pawl is in its catch-retaining position the abutment 63 engages the notch 57 of the catch 50 and prevents rotation of the catch.

When it is desired by an authorized user to release the striker and open the rotary latch, the pawl 60 must be rotated to its catch-releasing position. This requires a clockwise rotation as seen in FIGS. 28-30. This opening rotation will be against the bias of the spring 80, and supplemental spring 86, if a supplemental spring is used. The present invention provides an electromechanical opening feature. The gear train is activated to effect the following sequence of events. An electrical controller (not shown) is activated by the authorized user. The controller supplies electrical power to the motor 130, causing it to turn the pinion 132. Bevel gear teeth 133 engage the bevel gear teeth 123 of the bevel gear 120, thereby causing clockwise rotation of the bevel gear and its pinion 124. Pinion teeth 125 engage the teeth 112 of the idler gear 110, thereby transmitting counterclockwise rotary motion to the idler gear. The idler teeth 112 also engage the gear teeth 99 of the output gear 90, thereby transmitting a clockwise arcuate motion to the output gear. As seen in FIGS. 2 and 28-30, the output gear's lug 101 engages the slot 64 on the pawl 60 so that motion of the output gear 90 causes clockwise rotation of the pawl to the catch-releasing position shown in FIG. 29.

As the pawl 60 rotates to its catch-releasing position, it carries the abutment 63 out of engagement with the notch 57 in the catch 50. Once the abutment 63 is out of the notch 57, the spring 80 is able to rotate the catch to its unlatched position, as seen in FIG. 29. This opens up the U-shaped slot 51 of the catch, allowing release of the striker 5.

When the controller removes electrical power from the motor, the return spring 80 (possibly assisted by a supplemental spring 86) drives the pawl from the catch-releasing position of FIG. 29, to a catch-neutral position shown in FIG. 30. The catch-neutral position is rotated counterclockwise somewhat from the catch-releasing position of FIG. 29. In the catch-neutral position the pawl is biased by spring 80 so that the abutment 63 rests against the side of the catch, below the stop face 56 but not in the notch 57. Thus, the catch 50 is free to rotate from its unlatched position toward the latched position. And that is what the catch does when a striker 5 moves along the path 6 indicated schematically in FIG. 30. When a door or cover is closed, the striker moves along path 6 toward the open jaw 53 of the catch 50. The striker 5 hits the lower jaw 53 so that continued movement of the striker causes the catch to rotate counterclockwise toward the latched position. As this happens the spring 80 biases the pawl 60 counterclockwise, with the abutment 63 sliding along the face of the catch until the abutment slips into the notch 57, once again returning to its catch-retaining position of FIG. 28 where it prevents opening rotation of the catch.

It will be appreciated that various modifications and changes may be made to the above described preferred embodiment without departing from the scope of the following claims. For example, the electrical control circuit may include a switch that will sense the position of the catch 50. This switch gives feedback on latch status that is useful to the user and to any controller. The switch may advantageously be located in the motor compartment 11-4 or motor section 24 of the housing base and cover.

Further, while the rotary latch shown herein uses two rotating members, the catch and pawl, it will be understood that different numbers of rotating members could be used. For example, a common arrangement has a third rotating member that acts on the pawl to move it to a catch-releasing position. The rotary latch of the present invention could be arranged such that the output gear acts on this third rotating member. Thus, the rotary latch could act on any suitable rotating member in a multi-member linkage.

I claim:

1. A rotary latch, comprising:

a first plate and a second plate each having a planar primary portion, the primary portions of which lie in spaced, parallel planes;

first and second parallel posts connected to the first and second plates, the axes of the posts extending generally perpendicular to the first and second plates;

a catch mounted for rotation about the first post between latched and unlatched positions;

a pawl mounted for rotation about the second post between a catch-retaining position and a catch-releasing position, wherein when the catch is in the latched position and the pawl is in the catch-retaining position the pawl engages the catch and prevents it from rotating out of the latched position, and wherein when the pawl is in the catch-releasing position the catch is movable to its unlatched position;

a housing base mounted on the first and second posts;

a motor and gear train mounted in the housing base, the gear train including an output gear mounted for rotation about the second post and in engagement with the pawl such that activation of the motor causes the output gear to rotate the pawl to the catch-releasing position; and wherein the housing base comprises a case in which the motor and gear train are mounted and an upper plate positioned between the first and second plates and engageable with the first and second posts.

2. The rotary latch of claim 1 further comprising a housing cover engageable with the case to form an enclosure about the gear train.

3. The rotary latch of claim 1 further comprising a spring biasing the pawl to the catch-retaining position and wherein the motor and gear train are arranged such that upon deactivation of the motor said spring can effect a self-return of the motor and gear train.

4. The rotary latch of claim 3 wherein the gear train further comprises a supplemental spring biasing the gear train in the self-return direction.

* * * * *